United States Patent [19]

Compton et al.

[11] 4,064,432

[45] Dec. 20, 1977

[54] TENON FOR MOUNTING A LIGHTING FIXTURE

[75] Inventors: Wayne W. Compton, Irvine; Richard B. Shaner, Covina, both of Calif.

[73] Assignee: Kim Lighting, Inc., City of Industry, Calif.

[21] Appl. No.: 695,267

[22] Filed: June 11, 1976

[51] Int. Cl.[2] ..... B25G 3/20; F21S 1/10

[52] U.S. Cl. ..... 362/457; 403/370; 362/431

[58] Field of Search ..... 403/369–371, 403/7, 8; 240/84, 81 R, 52 R

[56] References Cited

U.S. PATENT DOCUMENTS

| | | | |
|---|---|---|---|
| 2,280,662 | 4/1942 | Pawsat | 403/370 |
| 2,508,039 | 5/1950 | Neuwirth | 403/369 X |
| 2,584,548 | 2/1952 | Calissi | 240/81 R UX |
| 3,156,418 | 11/1964 | Jablonski et al. | 240/84 |
| 3,225,187 | 12/1965 | Curtin | 240/84 X |
| 3,317,724 | 5/1967 | Pfaff | 240/84 |
| 3,339,065 | 8/1967 | Kelley | 240/84 X |
| 3,364,635 | 1/1968 | Guggemos | 240/84 X |
| 3,752,430 | 8/1973 | Kenyon et al. | 403/370 X |
| 3,755,977 | 9/1973 | Lewis | 240/84 X |

*Primary Examiner*—Donald A. Griffin
*Attorney, Agent, or Firm*—Donald D. Mon

[57] ABSTRACT

A tenon for mounting a lighting fixture to a support. The tenon has a cavity accessible through a removable cover, inside which a wiring splice can be made to join the wiring from the lighting fixture to other electrical circuitry wiring. The splice can be made and inspected at the tenon without removing the lighting fixture from the tenon or from the support. Means is also provided to mount the tenon to the support, and to mount the fixture to the tenon.

20 Claims, 5 Drawing Figures

FIG. 1
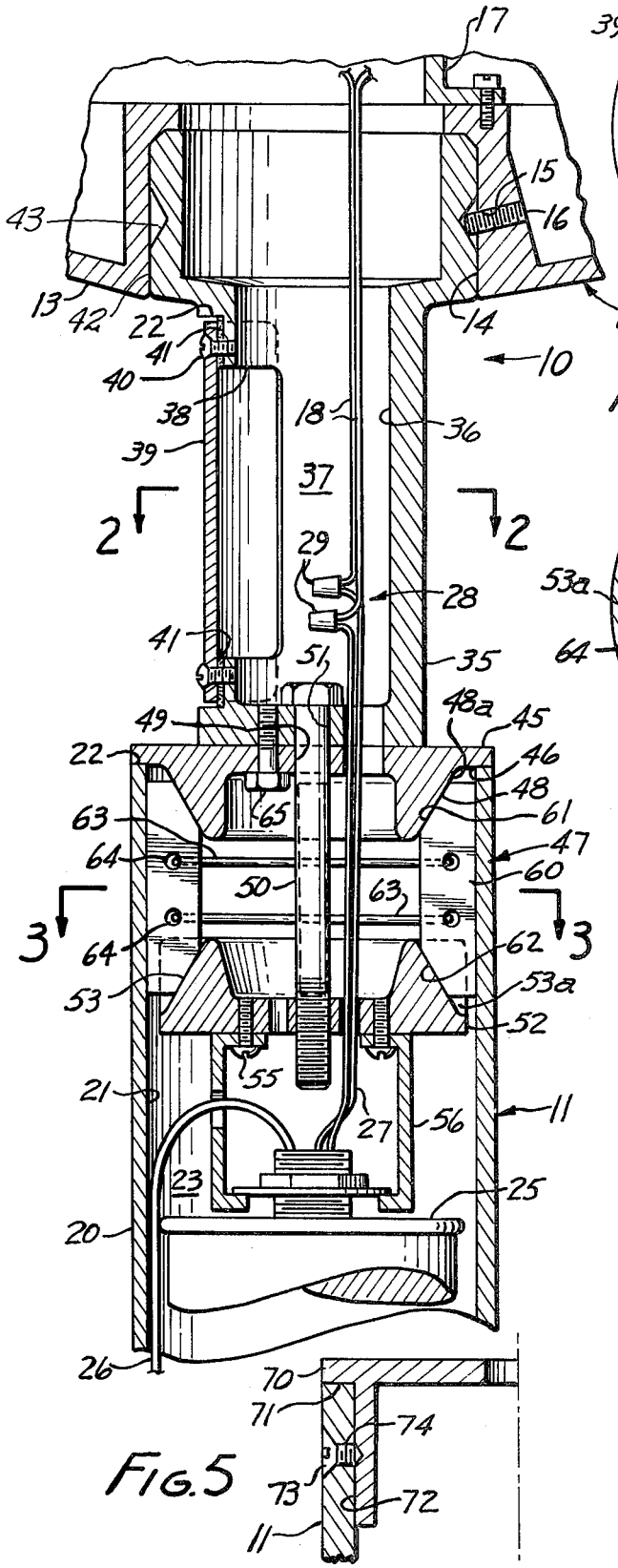
FIG. 2
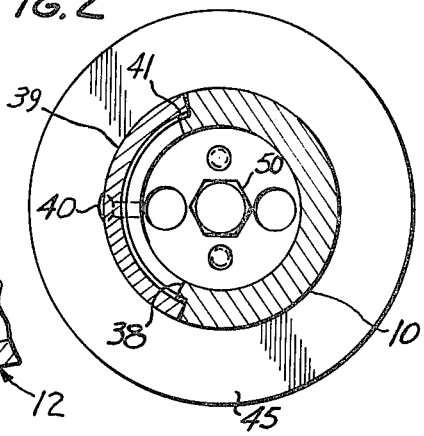
FIG. 3
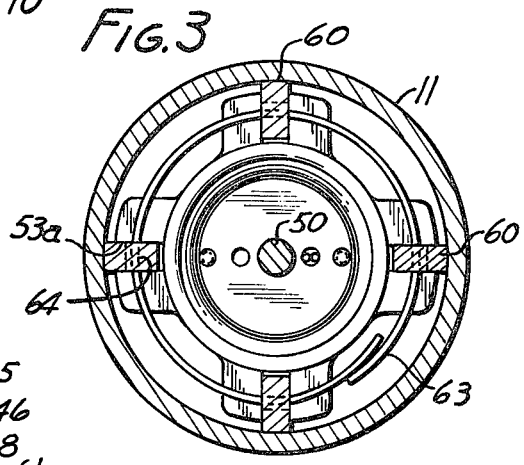
FIG. 4
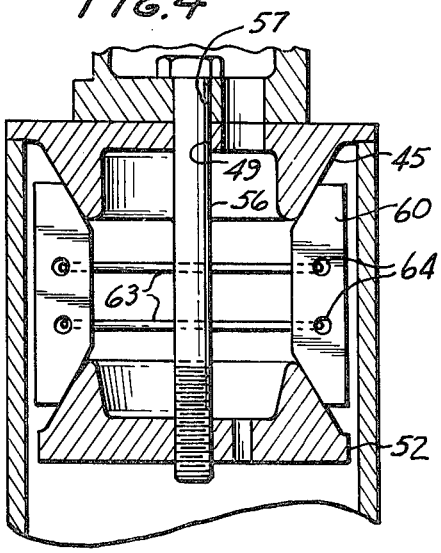
FIG. 5

TENON FOR MOUNTING A LIGHTING FIXTURE

This invention relates to a tenon for mounting a lighting fixture to a support, and to means for making available for inspection a wiring splice without removing the lighting fixture from the tenon, or the tenon from the support.

One of the disadvantages of presently known lighting fixtures of the type which are supported on a support such as a pole is that in order for an inspector to inspect the wiring splice between the more permanent circuit wiring and the wiring directly from the fixture, the lighting fixture itself must be removed from the support. This is a cumbersome, labor consuming process which ought to be eliminated if possible.

It is an object of this invention to provide a tenon for mounting a lighting fixture to a support wherein the wiring splice can be inspected without having to remove the lighting fixture from the tenon or from the support.

Another object of this invention is to conceal the mounting means in such a way that no fasteners are visible on the side of the pole itself, thereby providing a more esthetically desirable arrangement.

A lighting fixture tenon according to this invention is intended to mount the fixture to a support such as a pole. The pole might be upright from a base, or project downwardly, suspended from an overhead member such as a beam or ceiling. The fixture itself customarily includes wires to be spliced to circuit wiring extending from the support. The tenon comprises a body having a wall that defines an internal cavity in which the splice is to be located. An aperture is formed in the wall, and a cover is removably attachable to the wall so as to close said aperture and to be removable to give access to the cavity. Means is provided for mounting the tenon to the support. The tenon has openings adjacent to each of said means to admit wires to the cavity.

According to a preferred but optional feature of the invention, the body of the tenon is tubular.

According to another preferred but optional feature of the invention, the means for mounting the tenon to the support comprises an adapter having a shoulder which is so proportioned and arranged as to engage an end surface on the support, and also having an entry portion so proportioned and arranged as to enter the support, and an engagement means to hold the adapter to the support.

According to another preferred but optional feature of the invention, the means for mounting the lighting fixture to the tenon comprises an external peripheral groove extending around the body which is engageable by fastener projecting from the lighting fixture.

The above and other features of this invention will be fully understood from the following detailed description and the accompanying drawings in which:

FIG. 1 is a side view, principally in axial cross-section, of the presently preferred embodiment of the invention;

FIGS. 2 and 3 are cross-section taken at lines 2—2 and 3—- 3 respectively in FIG. 1;

FIG. 4 is a fragmentary showing of part of FIG. 1 with the parts thereof in a different angular orientation to one another and FIG. 5 is a fragmentary axial cross-section showing another form of means for mounting the tenon to the support.

In FIG. 1 there is shown a tenon 10 located atop a support 11 such as a vertical tubular pole. A lighting fixutre 12 is supported atop the pole.

The lighting fixture may be of any desired configuration, and is not shown in detail. It includes a base 13 having a recess 14 and several passages 15 (only one is shown in which respective set screws 16 are threaded). The fixture includes a socket support 17. An enclosure may be attached to base 13 to enclose a light bulb (not shown). Lighting fixture wiring 18 extends downwardly from the lighting fixture.

The support is a pole having an outer wall 20, an inner wall 21, and an upper end surface 22. A passage 23 is formed in the pole. This pole is an example of an upright support, and is supported at the ground by any desired means, for example a foundation. The invention also comprehends supporting the fixture from a dependent, or even from a horizontal, support. These could be attached to suitable structure such as a wall, ceiling, or beam. The orientation of the pole is of no importance to the invention. The term "pole" does not limit this member to a cylindrical construction. It is used in the generic sense of the word in this field to mean a supporting member for the fixture, and the shape in arbitrary.

There is shown circuit means 25 such as a ballast which is connected to conduitry leading to a power circuit through wiring 26 and from which wiring 27 extends to be joined at a splice 28. Wire nuts 29 are shown holding the wires together. One of the objects of this invention is to make the splice available for inspection without requiring removal of the light fixture from its mounting means.

Tenon 10 comprises a body 35 which is advantageously but not necessarily tubular. It includes a wall 36 which forms an internal cavity 37 within which the splice is located. An aperture 38 is formed in the said wall. It can be closed by a removable cover plate 39. The cover plate is held in position by a pair of screws 40. A gasket 41 can be placed between the cover and the body. The tenon is placed at the end (in this case, the top) of the support means. The cover forms part of the general tubular shape of the outside of the tenon, and will not be regarded as an aesthetically displeasing portion. To secure access both to make the splice and to inspect it, screws 40 need merely be loosened, and the cover removed. Persons are not aesthetically offened by screws which hold a removable cover in place. These are not in the pole itself, where they could be offensive to some people. The teneon includes "fixture mounting means" in the form of a head 42 integral with the body which fits into the recess 14 of the fixture. It includes a peripheral groove 43 that receives the tip ends of set screws 16 to hold the fixture means to the tenon. The fixture mounting means thereby comprises the head, the groove, and the set screws.

It is advantageous to provide tenon mounting means for mounting the tenon to the support which does not require screws or other externally visible means where it might be regarded as aesthetically displeasing. This is an optional advantage. As shown in FIG. 1 an adapter 45 is provided with a shoulder 46 that abuts the upper end 22 of the support means. In some upright installations this alone may be sufficient to hold the tenon to the support. However, winds can exert a lifting force on lighting fixtures, and it is better practice to make a strong connection. For this purpose a spreader means 47 is provided. The adapter has cam surfaces 48 at the base of slots **48*a*. There are four of these slots and surfaces, 90° apart from one another. The adapter has an opening 49 freely to journal a headed and threaded bolt 50 which bears against the tenon and passes through an opening 51 therein. The shank of the bolt extends down to a spreader 52 to which it is theaded. The spreader member has cam surfaces 53 which face in the opposite direction from cam surface 48 and can be drawn toward them by appropriate rotation of the bolt. Cam surfaces 53 are formed at the base of slots 53***a*. There are fours slots 53*a* and cam surfaces 53, spread 90° apart from one another. The bolt head can be reached through the cavity of the tenon for engagement by a wrench.

A plurality (in this example, four) of spreader bars 60 are disposed around the central axis. Each one has a cam surface 61, 62 and these respectively face cam surfaces 48 and 53. Springs 63 are threaded through holes 64 in the spreader bars to hold them assembled as a group, and to bias them lightly inwardly against cam surfaces 48 and 53. That part of adapter 45 which enters the support is sometimes called an "entry portion".

Bolt 65 holds adatper 45 to the base end of the tenon.

FIG. 5 illustrates that it is possible to hold the tenon to the pole by tenon mounting means which do pierce the pole. There are some installations where this is tolerable. For such an installation, an adapter 70 is attached to the tenon. It includes a shoulder 71 that bears on the end surface of support 11. A skirt 72 depends from the adapter and fits in the pole. Skirt 72 is sometimes called an "entry portion". Set screws 73 are threaded through the pole and engage the skirt in a groove 74. Alternatively, screw 73 could freely fit in a hole in the pole, and thread into the skirt. This arrangement provides the splice-inspection advantage, but forfetis the esthetic advantage of having no screws through the pole itself.

To make the preferred installation, the circuit means 25 is attached to the spreader by means of screws 55 and brackets 56. The mounting means thereby also can provide means for mounting the circuit means. Bolt 50 it turned so as to move the spreader away from the adapter. The spreader bars move inwardly as a consequence of the spring bias. Then the attachment means is put in place with the shoulder bearing on top of the pole.

Then a socket wrench is applied to the head of the bolt, and it is turned so as to pull the spreader toward the adapter. The cam surfaces cause the spreader bars to bear strongly against the inside wall of the pole, and this will hold the tenon firmly in place without piercing the wall of the pole.

The wires from the circuit means will have already been pulled into the cavity. The fixture is next placed atop the tenon, while pulling the wires from the fixture into the cavity. The fixture is attached to the tenon by tightening the set screws.

Now, with the cover plate removed, the ends of the wires can be pulled from the cavity, and the splice made. The splice can then be tucked into the cavity, and the cover plate replaced. When the splice is to be inspected, the cover plate need merely be removed and later replaced.

The device of FIG. 5 is attached to the pole as shown. The wiring splicing is done as described above.

The invention thereby provides an elegantly simple means to mount a fixture to a support, and to enable its wiring splice to be inspected without removing the fixture or the tenon.

If the support is other than circular, the shape of the attachment means will be similarly modified. For example, for a square pole, the wedges would extend into the corners of the square passage.

This invention is not to be limited by the embodiments shown in the drawings and described in the description, which are given by way of example and not of limitation, but only in accordance with the scope of the appended claims.

I claim:

1. A lighting fixture tenon for structurally mounting a fixture to a support, the fixture including wires to be spliced to wiring from the support at a splice within the tenon, said tenon comprising: a structural body having a wall defining an internal cavity and having an aperture in said wall; a cover removably attachable to said wall to close said aperture; fixture mounting means for structurally mounting the lighting fixture to the body; and tenon mounting means for structurally mounting the body to the support comprising an adapter including a shoulder which is so proportioned and arranged as to engage an end surface on said support, an entry portion so proportioned and arranged as to enter said support, and engagement means to hold the adapter to the support, the tenon having openings adjacent to each of said means to admit wires to be spliced inside said cavity, said splice being accessible for inspection by removing the cover.

2. A lighting fixture tenon according to claim 1 in which the said body is tubular.

3. A lighting fixture tenon according to claim 2 in which the means for mounting the lighting fixture to the tenon comprises an external recess in said tenon for reception of said engagement by fastener means carried by the lighting fixture.

4. A lighting fixture tenon according to claim 3 in which the recess is a peripheral groove extending around the body.

5. A lighting fixture tenon according to claim 1 in which the engagement means comprises a fastener engaged to the support and adapted to be brought against the entry portion to hold it in place.

6. A lighting fixture tenon according to claim 1 in which the engagement means comprises spreader means attached to said entry portion.

7. A lighting fixture tenon according to claim 6 in which the adapter has a cam surface, and in which said spreader means comprises a spreader member having a cam surface, a spreader bar between said cam surfaces, and means for pulling the spreader member against the spreader bar, whereby to press the spreader bar against said support.

8. A lighting fixture tenon according to claim 7 in which a plurality of said spreader bars is placed between respective cam surfaces, said spreader bars being interconnected by spring means which tend when relaxed to draw the spreader bars away from the support.

9. A lighting fixture tenon according to claim 7 in which the means for pulling the spreader member comprises a headed bolt journaled for free rotation in the tenon and threadedly engaged to the spreader member.

10. A lighting fixture tenon according to claim 7 in which a plurality of said spreader bars is placed between respective cam surfaces, said spreader bars being angularly spaced apart from one another.

11. A lighting fixture tenon according to claim 10, in which the means for pulling the spreader member comprises a headed bolt journaled for free rotation in the tenon and treadedly engaged to the spreader member.

12. A lighting fixture tenon according to claim 1 in which circuit means is tenon mounted to the mounting means inside the support.

13. In combination: a support; electrical circuit wiring inside said support; a lighting fixture including electrical circuit wiring; and a lighting fixture tenon according to claim 1, said wiring being joined in a splice within said tenon, which splice is accessible through said aperture when the cover is removed.

14. A combination according to claim 13 in which the engagement means comprises a fastener engaged to the support and adapted to be brought against the entry portion to hold it in place.

15. A combination according to claim 13 in which the engagement means comprises spreader means attached to said entry portion.

16. A combination according to claim 15 in which the adapter has a cam surface, and in which said spreader means comprises a spreader member having a cam surface, a spreader bar between said cam surfaces, and means for pulling the spreader member against the spreader bar, whereby to press the spreader bar against said support.

17. A combination according to claim 16 in which a plurality of said spreader bars is placed between respective cam surfaces, said spreader bars being interconnected by spring means which tend when relaxed to draw the spreader bars away from the support.

18. A combination according to claim 16 in which a plurality of said spreader bars is placed between respective cam surfaces, said spreader bars being angularly spaced apart from one another.

19. A combination according to claim 18 in which the means for pulling the spreader member comprises a headed bolt journaled for free rotation in the tenon and threadedly engaged to the spreader member.

20. A combination according to claim 15 in which the means for pulling the spreader member comprises a headed bolt journaled for free rotation in the tenon and threadedly engaged to the spreader member.

* * * * *